US009975024B1

(12) United States Patent
Potter

(10) Patent No.: US 9,975,024 B1
(45) Date of Patent: May 22, 2018

(54) ATHLETIC TRAINING SLED PROVIDING ADDITIONAL METHODS OF RESISTANCE TRAINING TO ARM AND LEG MOVEMENTS WHILE RUNNING

(71) Applicant: Mark William Potter, Friendswood, TX (US)

(72) Inventor: Mark William Potter, Friendswood, TX (US)

( * ) Notice: Subject to any disclaimer, the term of this patent is extended or adjusted under 35 U.S.C. 154(b) by 0 days. days.

(21) Appl. No.: 15/798,688

(22) Filed: Oct. 31, 2017

Related U.S. Application Data

(60) Provisional application No. 62/464,214, filed on Feb. 27, 2017.

(51) Int. Cl.
*A63B 21/00* (2006.01)
*A63B 21/055* (2006.01)
(Continued)

(52) U.S. Cl.
CPC .... *A63B 69/0028* (2013.01); *A63B 21/00061* (2013.01); *A63B 21/00065* (2013.01); *A63B 21/00069* (2013.01); *A63B 21/0557* (2013.01); *A63B 21/154* (2013.01); *A63B 21/4007* (2015.10); *A63B 21/4009* (2015.10); *A63B 21/4013* (2015.10); *A63B 21/4021* (2015.10); *A63B 21/4035* (2015.10); *A63B 23/03575* (2013.01); *A63B 24/0062* (2013.01); *A63B 69/0035* (2013.01); *A63B 2022/0092* (2013.01); *A63B 2209/00* (2013.01); *A63B 2209/02* (2013.01); *A63B 2220/17* (2013.01); *A63B 2220/20* (2013.01); *A63B 2220/22* (2013.01); *A63B 2220/30* (2013.01); *A63B 2220/50* (2013.01); *A63B 2220/56* (2013.01);
(Continued)

(58) Field of Classification Search
CPC ..... A63B 21/0004; A63B 21/06–21/08; A63B 21/4043; A63B 22/20; A63B 23/047; A63B 69/02; A63B 69/34–69/345
See application file for complete search history.

(56) References Cited

U.S. PATENT DOCUMENTS 3,326,553 A * 6/1967 Forrest ..... A63B 69/345 280/47.34
6,086,517 A * 7/2000 Schapmire ..... A63B 21/015 482/68

(Continued)

*Primary Examiner* — Loan H Thanh
*Assistant Examiner* — Jennifer M Deichl
(74) *Attorney, Agent, or Firm* — Buskop Law Group, P.C.; Wendy Buskop

(57) ABSTRACT

The present invention comprises a novel sled training device generally consisting of a sled with vertically oriented pole for attaching, a detachable cuboidal structure that attaches to the sled and holds pulley systems with stretch cords running through them and then to the ankles and wrists of the user. A rope or stretch cord attaches to the front of the sled and runs to an attachment point on a harness worn by the user when the apparatus is configured to be pulled by the user. The apparatus may be configured to be pushed by the user by means of an attachment that connects to the vertically oriented pole for attaching weights, and which has padded structures to be pushed by the subject's shoulders and/or forehead. The detachable cuboidal structure may be removed from the sled and attached to any stationary structure for use without the sled.

15 Claims, 10 Drawing Sheets

(51) Int. Cl.

| | |
|---|---|
| ***A63B 22/00*** | (2006.01) |
| ***A63B 23/035*** | (2006.01) |
| ***A63B 24/00*** | (2006.01) |
| ***A63B 69/00*** | (2006.01) |

(52) U.S. Cl.
CPC ..... *A63B 2225/093* (2013.01); *A63B 2225/50* (2013.01); *A63B 2230/06* (2013.01); *A63B 2230/50* (2013.01); *A63B 2230/60* (2013.01)

(56) References Cited

U.S. PATENT DOCUMENTS

| | | | | |
|---|---|---|---|---|
| 2013/0172160 | A1* | 7/2013 | Poole | A63B 21/0552 482/129 |
| 2013/0331239 | A1* | 12/2013 | Richards | A63B 23/0405 482/102 |
| 2016/0271478 | A1* | 9/2016 | Kabes | A63B 71/0009 |
| 2017/0136285 | A1* | 5/2017 | Chessen | A63B 21/4035 |
| 2017/0189733 | A1* | 7/2017 | Bentley | A63B 21/06 |
| 2017/0282008 | A1* | 10/2017 | Williams | A63B 22/20 |
| 2017/0296858 | A1* | 10/2017 | Towley | A63B 21/06 |
| 2017/0326402 | A1* | 11/2017 | Sorin | A63B 21/0442 |

* cited by examiner

ATHLETIC TRAINING SLED PROVIDING ADDITIONAL METHODS OF RESISTANCE TRAINING TO ARM AND LEG MOVEMENTS WHILE RUNNING

The present application claims priority to U.S. Provisional Patent Application Ser. No. 62/464,214, filed on Feb. 27, 2017, for "ATHLETIC TRAINING SLED PROVIDING ADDITIONAL METHODS OF RESISTANCE TRAINING TO ARM AND LEG MOVEMENTS WHILE RUNNING." This reference is hereby incorporated in their entirety.

FIELD

The present invention relates to athletic training devices, in particular, to athletic training sleds and pulley systems with stretch cords.

BACKGROUND

Athletic training sleds have been used for decades to provide resistance training to athletes wishing to run faster. Typically, the sleds are attached to the user via static non-extending stretch cord straps attached to sled on one end, and to the user by means of a harness. The sleds typically include a vertically oriented bar that passes through weights that rest on top of the sled. In this configuration, the user walks to the point where slack is removed from the straps, and then when he or she is ready, runs linearly so that the weight of the sled and any weights placed on top of it resist his or her efforts. The purpose of this training is to provide resistance training to the users to increase strength in the muscles used for running.

These sleds, however, provide resistance only to the backward motion of the user's legs. Running involves many other coordinated movements by the arms and legs that are not resisted while using the devices. While running, each of the user's arms move in both forward and backward directions to balance the movement of the opposite leg. It is well understood that as a runner's legs become faster and more powerful, the arms must also become faster and more powerful to properly balance the runner. Indeed, a runner's speed may be limited by arms that are not sufficiently strong or fast to maintain balance with the opposite legs. Moreover, the sleds train each leg only as it pushes against the ground (ground stroke) to move in the opposite direction of the force application. After the ground stroke is completed, the leg must return to its forward most position as quickly as possible to begin another cycle. As a runner is accelerating, the proper running mechanics dictate bringing the knee forward and upwards to a point where the length of the stride (stride length) is optimized and the knee is sufficiently elevated to maximize the force that may be applied to the ground during the ground stroke. Without any resistance to the forward movement of a leg returning to this point, the current systems fail to train an important component of the running movement pattern.

There are training sleds that provide resistance to running by requiring pushing rather than pulling the devices. One example is the blocking sled in which football players push the sled using their shoulders, sometimes with a coach riding on the sled to add additional weighted resistance. These sleds, however, have only this single function in which the users push the sled. Other devices allow the user to push the device using his or her hands on a handle. Such devices are of limited training value because the hands are occupied with pushing the devices resulting in unnatural movement patterns and failing to train or exercise the arms dynamically.

In addition to training sleds, there are athletic training systems utilizing stretch cords, tubes or bands (hereinafter, all such stretch items shall be referred to as stretch cords for simplification herein only) attached to a system of rollers that provide resistance to both running and jumping by means of attachment to the user's ankles and/or wrists. Typically, the user attaches stretch bands that are running through a pulley system attached to a static non-extending stretch cord board or box, and performs athletic movements such as running or jumping so that the stretch bands resist those movements.

The present embodiments meet these needs. Current training systems include sleds that provide weighted resistance opposing running forces to increase the athletes' force application and rotations per minute in normal (non-sled resisted) running applications. These systems, however, provide no resistance for the athletes' arms so that the upper body is not trained with resistance. As a consequence, current sled training systems ignore a vital component in running faster—moving the athletes' arms and shoulders faster and with more power to counter the forces created by the lower body.

The invention solves this problem by creating resistance of varying levels depending on the athletes' training level to the arm and shoulder movements.

A second problem with sled training systems in the prior art is that when they resist a user pushing the sled, the user must use his hands as the nexus with the apparatus, thereby preventing the user from moving his or her arms. Running without moving one's arms is unnatural and fails to adequately train the athlete to utilize his or her entire body as he or she would in competition. The current invention solves this problem by including an attachment that allows the user to push the sled with his or her shoulders at the trapezius, thereby freeing his or her arms to move freely and naturally. Moreover, when the present invention is used with this attachment the stretch bands are attached as usual to the user's ankles and wrists, but provide stretched resistance to movements of the arms as they move backwards and the legs as the push backwards through the ground stroke. Therefore, resistance to arm movement may be applied in both the forward and backward directions, developing strength and power in the full range of arm movement. Moreover, imbalances in force application on the ground are corrected by the user's arms. For instance, if the user is applying greater force with his or her right foot, he or she may correct this by applying more force with his or her left hand on the device. By pushing with the shoulders, the user must use proper running techniques and maintain balanced ground force application with each foot. The attachment arm is attached to the device by sliding into the pole attached to the sled for attaching weights, and also includes a protractor attachment with holes and corresponding collapsible pegs to allow adjustment of the arm's height for users of different statures.

BRIEF SUMMARY OF THE INVENTION

The present invention comprises a novel sled training device generally consisting of a sled with vertically oriented pole for attaching weights by placing the weights so that the vertically oriented pole runs through a hole in the center of the weights, a system of stretch cords running through pulley systems, and an attachment for pushing the device with the user's shoulders.

BRIEF DESCRIPTION OF THE DRAWINGS

The detailed description will be better understood in conjunction with the accompanying drawings as follows.

Figure 1:
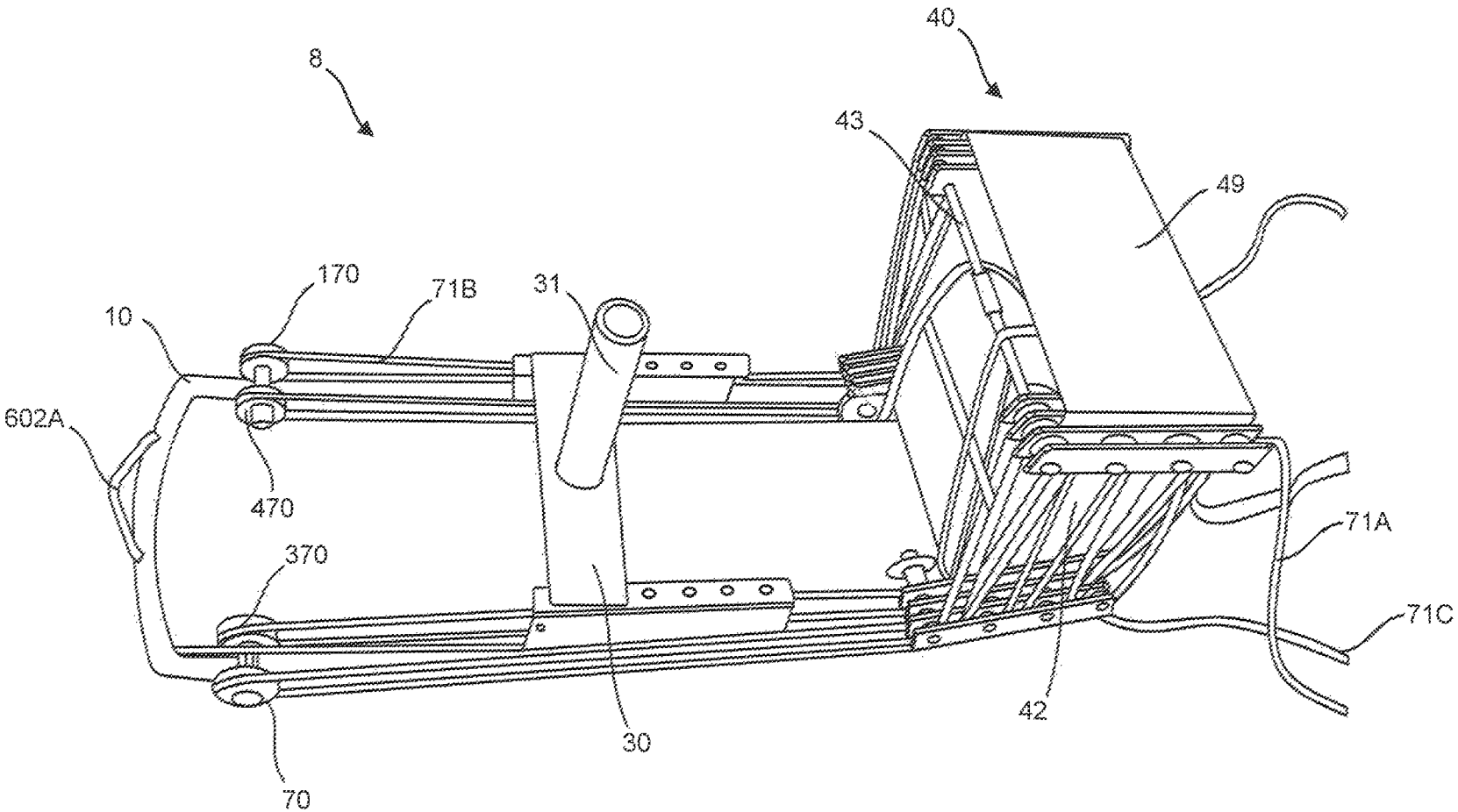
FIG. 1 depicts a perspective view of the speed and power development system.

The present embodiments are detailed below with reference to the listed Figures.

DETAILED DESCRIPTION OF THE EMBODIMENTS

The terminology used herein is for the purpose of describing particular embodiments only and is not intended to be limiting of the invention. As used herein, the term "and/or" includes any and all combinations of one of more of the associated listed items. As used herein, the singular forms "a," "an," and "the" are intended to include the plural forms as well as the singular forms, unless the context clearly indicates otherwise. It is further understood that the terms "comprises" and/or "comprising," when used in this specification, specify the presence of states features, steps, operations, elements, and/or components, but do not preclude the presence or addition or one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined.

In describing the invention, it will be understood that a number of techniques and steps are disclosed. Each of these has individual benefit and each can also be used in conjunction with one or more, or in some cases, all, of the other disclosed techniques. For the sake of clarity, this description will refrain from repeating every possible combination of the individual steps in an unnecessary fashion. Nevertheless, the specification and claims should be read with the understanding that such combinations are entirely within the scope of the invention and the claims.

New and unobvious athletic training sleds with stretch cords, pulley systems and attachments are discussed herein. In the following description, for purposes of explanation, numerous specific details are set forth to provide a thorough understanding of the present invention. It will be evidence, however, to one skilled in the art that the present invention may be practiced without these specific details.

The present disclosure is to be considered an exemplification of the invention, and is not intended to limit the invention to the specific embodiments illustrated by the figures or description below.

The present invention will now be described by referencing the appended figures representing preferred embodiments. In each of these preferred embodiments, the devices and items represented by the drawings may be composed of any number of different materials including but not limited to any metal (e.g., Aluminum), alloy, rubber, Kevlar™, plastic, fiber glass, etc. Each description will include the materials to be used in preferred embodiments, but such descriptions are not limited to the materials disclosed in them and an unlimited number of other materials may be substituted for those used in the preferred embodiments disclosed herein.

Embodiments may comprise a training sled device in its configuration utilizing the attachment arm against which the user pushes with his or her shoulders while his or her wrists and ankles are attached to stretch tubes. The present invention is constructed out of any material with sufficient durability and strength to endure daily utilization on smooth or rough terrain, including aluminum, metal alloys, steel, titanium, carbon-based materials, fiber glass, plastics, Kevlar™, etc. The most common material used in present training sleds is a metal such as Aluminum because of its durability and relatively inexpensive utilization, among other factors.

The apparatus has an overall design with a base that is similar to existing training sleds with the apparatus built upon on any number of tubes, pipes, skis or flat surfaces designed to allow the device to slide over surfaces including the ground, tracks, fields, gyms, etc. running from front to back resting on the floor or ground as shown in the FIGS.

The interface with the ground/floors allows the apparatus to slide over the ground/floor when the athlete pulls or pushes on it. In the preferred embodiment, there are two tubular cylinders made of steel measuring three feet in length and one inch in diameter. In another preferred embodiment, two flat pieces of metal in the shape of snow skies and measuring 3 feet in length, 2 inches in width, and ⅛ inch in depth are used in place of cylinders. In either preferred embodiment, both the front and rear ends of each Ski curving up three inches on the front and backside (or laid flat). For purposes of this description, these tubes, rods or pipes providing the interface with the ground/floors shall be referred to as "Skis." The Skis are aligned parallel to one another on the same horizontal plane and fastened together using any number of crossbars made of any material with sufficient durability and strength to endure daily utilization on smooth or rough terrain, including aluminum, metal alloys, steel, titanium, carbon-based materials, fiber glass, plastics, Kevlar™, etc. The most common material used in present training sleds is metal most likely because of its durability and relative inexpensive utilization. In the preferred embodiment, the Skis are connected using two cylinder tubes made of metal of any measure, but in the preferred embodiment, measuring 1 inch in diameter and 13 inches in length. These two cross-cylinders/cross-bars are connected at the rear and front of the Skis respectively.

A bracket/handle of any dimension that will fit on the front cross-cylinder/cross-bar for the chest harness strap's attachment clip to be placed for towing is attached to the leading edge of the front cross-cylinder/cross-bar. This bracket/handle is used for attaching the strap connected to the chest harness the athlete wears while using the apparatus. The preferred embodiment for the base of this apparatus is 36 inches in length and anywhere from 13 to 42 inches in width. Consequently, the cross-cylinders/cross-bars attaching to the Skis may be any length, but in the preferred embodiment will be from 13 to 42 inches in length.

Weight Base. Also attached on the top edge of the Skis by any means, including by welding, bolting, etc., is a horizontally oriented rectangular or similar shape flooring made of any material with sufficient durability and strength to endure daily utilization on smooth or rough terrain, including aluminum, metal alloys, steel, titanium, carbon-based materials, fiber glass, plastics, Kevlar™, etc. for the desired weight to be placed. The dimensions and shape of this plate vary with the various dimensions and embodiments of the Skis, but in the preferred embodiment measure 13 inches in width by 13 inches in length, and V inch in depth. Located in the center of the Weight Base, oriented vertically and perpendicular to the plane of the Weight Base, is a weight cylinder made of any material with sufficient durability and strength to endure daily utilization on smooth or rough terrain, including aluminum, metal alloys, steel, titanium, carbon-based materials, fiber glass, plastics, Kevlar™, etc. measuring 1⅝ inch in diameter and 12 inches in height. Hereinafter, this weight cylinder will be referred to as the Weight Cylinder. The purpose of the Weight Cylinder is holding weighted plates with circular holes in their centers as are commonly available through retailers. The weighted plates are placed so that the Weight Cylinder passes through the holes in the center of each weighted plate as it is added to the apparatus, and prevents them from falling off the apparatus. On the sides of the front cross-cylinders/cross-bars of the apparatus are stoppers which will be locked into place during running uses, but which the user may open and have the pointed or stoppered end will lock down into the ground to prevent the apparatus from moving while the trainee conducts training utilizing the apparatus in a static non-extending stretch cord position.

Drive Arm.

In embodiments the speed and power development system can have a Drive Arm 500 (shown in FIG. 9) attached to the moveable sled while it is pushed by the user. The apparatus includes an extension that the user will push against using his/her head. The extension is constructed out of any material with sufficient durability and strength to endure daily utilization on smooth or rough terrain, including aluminum, metal alloys, steel, titanium, carbon-based materials, fiber glass, plastics, Kevlar™, aluminum and steel. The cylinder of the drive arm is 1½ inch in circumference with 2 rounded ball pins located on the sides. These pins allow the drive arm to lock into the weight cylinder of the drive arm. The drive arm base in the preferred, but not the only, embodiments is 1 inch to 1 ft long. The arm extends in an upward angular direction 4 ft to 5 ft in distance and coming a point. This point is welded on by a 1 ft arm extending 1 ftin angular downward direction coming to a welded point. This welded point is extended to a 1 ft 100 drop flat bar that extends 1 ft in length that forks out into 2 pieces. In the preferred embodiment, these 2 forked pieces are constructed of inch thick and 3-inch-wide of flat bar, and are padded and are spaced to allow the user to push the sled with their head in between the 2 pieces.

Purpose of Drive Arm.

The purpose of the Drive Arm is to teach proper technique and posture in the initial drive/power phase of the sprints or exploding off the ball, and to allow the arms to move naturally in their full range of motion. It is intended that the Drive Arm, in the preferred embodiment, be used in conjunction with the stretch cords and pulley system by attachment to the user's wrists and ankles. By attaching the stretch cords in this manner, the device will train the user's arm movements in the directions opposite to the training with the stretch cords and pulley system while pulling the apparatus. That is, with the user facing the apparatus and pushing it, the stretch cords will resist the user's arm and leg movements moving from front to back (drive phase) rather than back to front (recovery phase) while pulling the apparatus.

Detachable Portable Agility Box.

Figure 9:
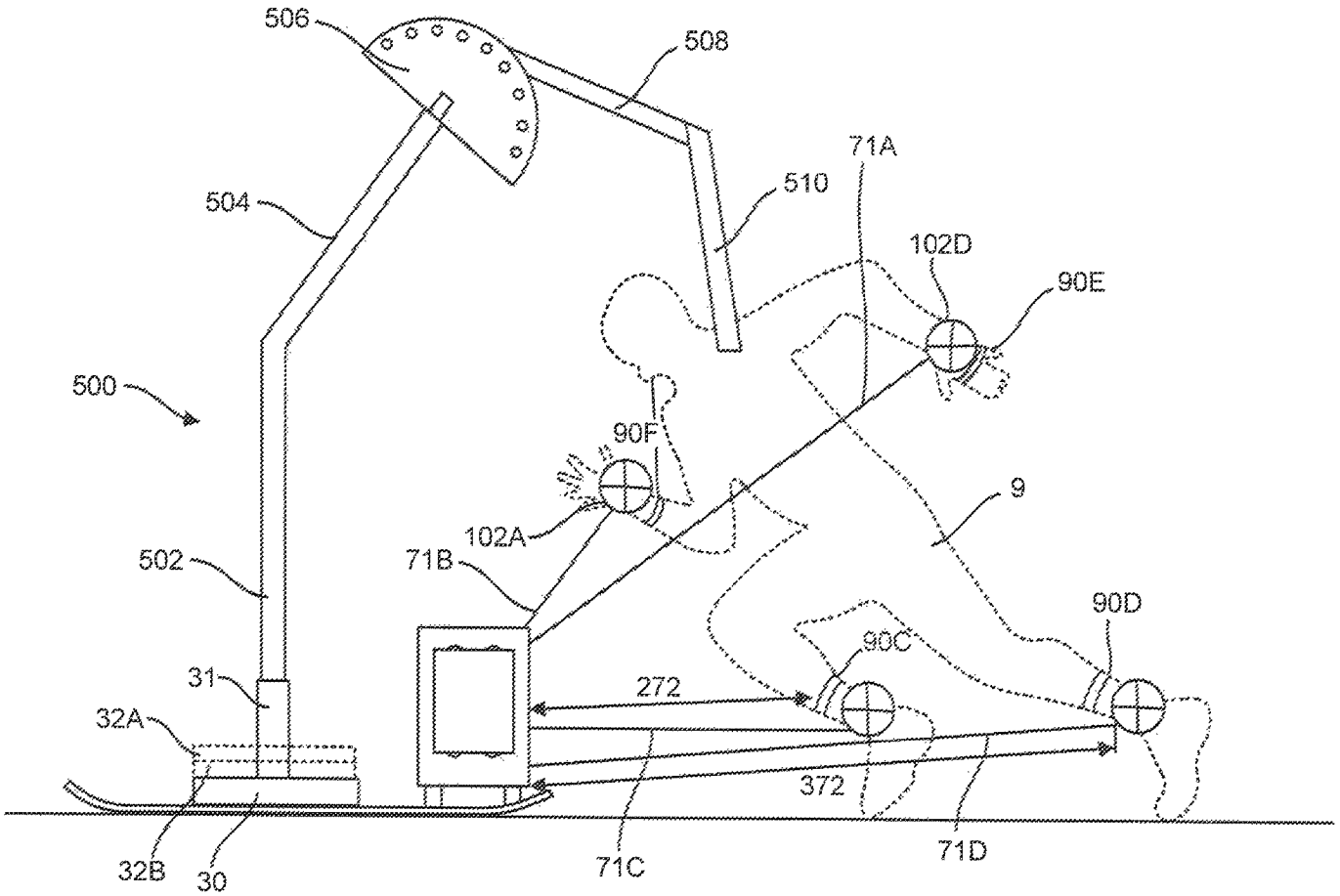
FIG. 9 is a side view of the speed and power development system using four stretch cords and with a removable drive arm.

In an embodiment, the apparatus in one configuration can be both pushed and pulled by a user. The pushing can be by the user via the Drive Arm. FIG. 9 illustrates the apparatus in its configuration in which it is pushed by the user by connecting him or her via harness 90C, 90D, 90E, and 90F and a strap and stretch cord running from an attachment to a harness.

In an embodiment, a harness is placed so that a horizontal strip runs around the user's abdomen or chest from the back attachment point and has a vertically oriented strap running over each shoulder and attaching to the attachment point. A rope, stretch cord, strap attaches to a loop composed of any suitable material and runs to an attachment on the base of the apparatus.

Figure 10:
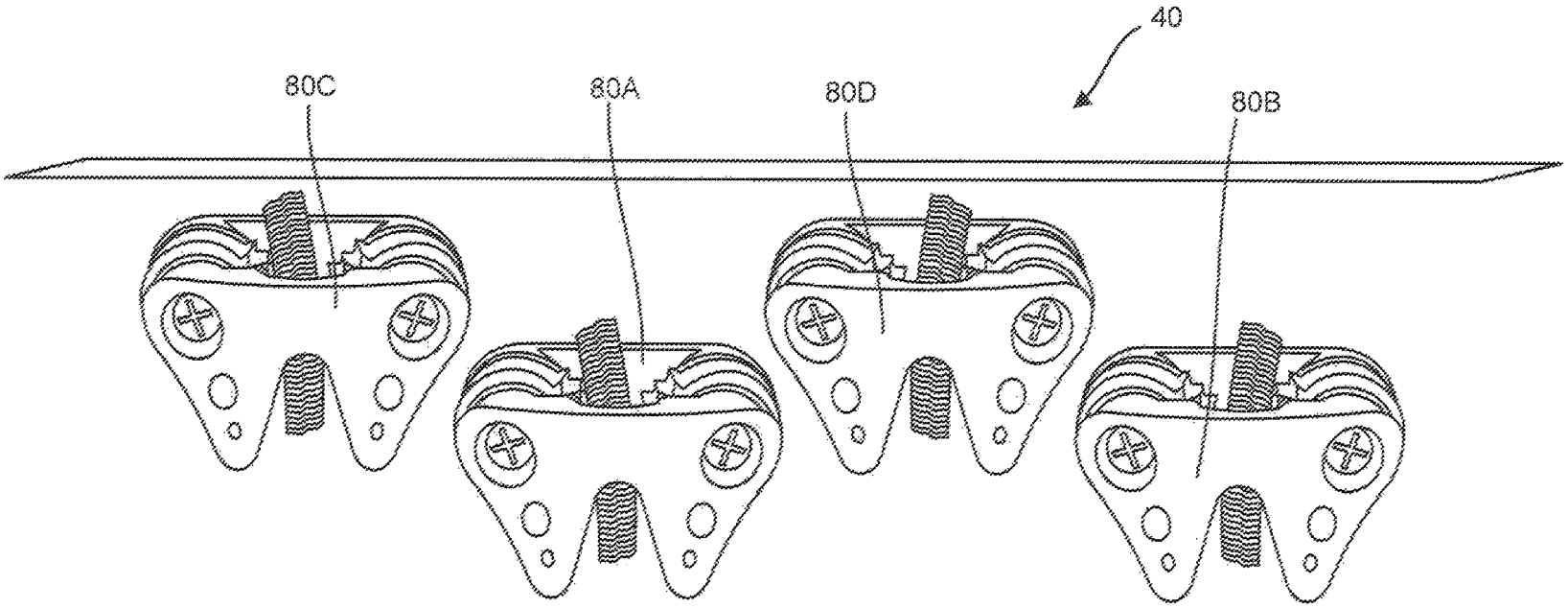
FIG. 10 depicts a plurality of lockable pulley system brackets of the speed and power development system.

The second lockable pulley system brackets 80A-D (FIG. 10). Each of the brackets illustrated in FIG. 10 is allocated to a different stretch cord, so that each one is for each limb attachment point. That is, a bracket attaches to the stretch cord that is attached to the left wrist, while another is attached to the stretch cord for the right wrist, another for the left ankle, and, finally, one for the left wrist. These brackets allow the bungee pulley system to be locked in and stationary and for each limb to function independently. The custom designed industrial pulley system can be locked in on the bracket. The rollers for the hands are located on the top right and top left side of the bracket, while the pulley's for the ankles are placed on the left and right side of the bracket. Trainees have a series of connecting combinations to the sled. They can connect to the sled with the waist and hands harness, waist and leg harness, just waist harness, hand and ankle harness or hands and leg harnesses.

The Agility Box (1B) is detachable from the base of the sled 10. After detachment, the user may carry the Agility Box and attach to any stationary structure, for example, a fence by any number of attachments. In its preferred embodiment, the sides of the Agility Box has four latches that can be latched onto a fence with four 1 inch straps. Each strap has a swivel bolt allowing a tight attachment of the Agility Box to the stationary structure. Each strap includes a latch that can be pulled to tighten the straps that will secure the box for safe and easy use. The front surface of the Agility Box includes holes allowing the stretch cords to pass through them. The rear surface of the Agility Box in its preferred embodiment includes a vertical sliding door allowing it to be closed.

Outside Box.

The Agility Box may be composed of any material, but in its preferred embodiment, is composed of aluminum, steel, plastic, or carbon fiber. The outer dimensions of the Agility Box may be of any number of different sizes and shapes. In a preferred embodiment, the Agility Box dimensions are 17 inches height×13 inches width and 8 inches depth.

This agility box can be enclosed with a sliding back door to stow away all items. The sliding back door may be composed of any material, but in its preferred embodiment, is composed of aluminum, steel, plastic, or carbon fiber, and has attached to it a handle or knob of any size and dimension sufficient to facilitate opening and closing the door. Cam cleats can be located on the outside for the ability to lock down the bungee shock stretch cords at any distance. Unique and custom design industrial performance pulley housing systems will be place on the outside for training purposes. In its preferred embodiment, each system will allow the user to connect to 1-16 different stretch cords in a multitude of different ways, although the apparatus could be built with additional pulley housing units to allow additional stretch cords.

Interior Box.

The interior of the Agility Box may be utilized for storage of any items including additional stretch cords. Unique and custom design industrial performance pulley housing system will be place on the inside of the agility box for training purposes. In its preferred embodiment, each system will allow the user to connect to 1-16 different stretch cords in a multitude of different ways, although the apparatus could be built with additional pulley housing units to allow additional stretch cords. Lockable pulley system brackets are also located on the inside for the ability to lock down the bungee shock stretch cords at any distance.

The invention provides rehabilitation to individuals with muscle injuries.

The embodiments assist senior citizens by strengthening their muscles, ligaments, and tendons; increasing joint functionality and providing them with better agility and balance.

The embodiments provide fitness training to first responders and military personnel.

The embodiments help prevent childhood obesity by providing regular physical fitness.

The embodiments provide assist individuals with high cholesterol, high blood pressure, and type 2 diabetes by providing the individuals with an alternative to prescription medicine.

The following definitions are used herein:

The term "speed and power development system" refers to the treatment of a muscle, ligament, or tendon to increase speed of a subject, or increase power of a subject for lifting or moving objects, or for therapeutic treatment of the muscle for rehabilitation purposes, or a combination thereof.

The term "harness" refers to straps and fittings that attach to a part of the subject. The harness can be a hand harness, wrist harness, knee harness, elbow harness, chest harness, waist harness, or an ankle harness.

The term "storage box" refers to a box contained within the agility box that is made from a lightweight material, such as plastic or aluminum and used to contain additional stretch cords or sensors used for measuring athlete development.

The term "moveable sled" refers to a frame built upon a plurality of tube skis or flat surfaces designed to allow the system to slide over a surface. The moveable sled attaches to the agility box, pulley system, and horizontally oriented raised weight base. The movable sled can be made out of any material capable of supporting the above components, such as aluminum, metal alloy, steel, titanium, carbon based materials, fiberglass, and plastic.

The term "static non-extending stretch cord" refers to a flexible material usually consisting of several strands woven or twisted together. On one end, the stretch cord which attaches to the harness worn by the user and attaches to the moveable sled on the other end. Examples of stretch cord material include, but are not limited to: nylon, cotton, hemp.

The term "horizontally oriented raised weight base" refers to a component of the speed and power development system that is attached horizontally opposed to the moveable sled base sides and capable accommodating a plurality of removable weights added by the user to increase the overall weight load of the system, thereby increasing sliding resistance of the moveable sled.

The term "agility box" refers to a housing mounted over the movable base which contains the pulley systems, rollers, lockable pulley system brackets, and the storage box. The agility box can be made from aluminum, metal alloy, steel, titanium, carbon based materials, fiberglass, and plastic.

The term "outside upper pulley system" refers to a plurality of upper rollers mounted on the outside surface of the walls and spaced apart from the outside lower pulley system.

The term "outside lower pulley system" refers to a plurality of lower rollers mounted on the outside surface of the walls and spaced apart from the outside upper pulley system.

The term "outer roller" refers to a component of the pulley system mounted to the outsides surface of the walls that allows the flexible and extendable one piece stretch cord to be threaded sequentially allowing proper usage.

The term "lockable pulley system bracket" refers to a device used to secure the flexible and extendable one piece stretch cord at variable lengths to allow the subject to perform the desired movement with the preferred weighted load. The lockable pulley system bracket can be made out of any material capable of securing the flexible and extendable one piece stretch cord.

The term "flexible and extendable one piece stretch cord" refers to an elasticized stretch cord used to provide resistance when elongated by the subject. Common examples include, but are not limited to, a bungee stretch cord, a speed stretch cord, or a shock stretch cord.

The term "first rod" refers to a component that attaches between the walls of the on a back side of the agility box, maintaining the alignment of the upper back rollers The term "second rod" refers to a component that attaches between the walls of the agility box on a front side, maintaining the alignment of the upper front rollers.

The term "wall" refers to a piece of material mounted perpendicular to the moveable sled and attaches to the removable lid forming the sides of the agility box. The wall provides structural integrity to the agility box allowing proper function of the upper pulley system. The wall can be made out of any material capable of supporting the above components, such as aluminum, metal alloy, steel, titanium, carbon based materials, fiberglass, and plastic.

The term "removable lid" refers to the piece of material that engages the walls of the agility box. The removable lid can be made out of any material capable of supporting the above components, such as aluminum, metal alloy, steel, titanium, carbon based materials, fiberglass, and plastic.

The term "upper roller" refers to a component of the pulley system that allows the flexible and extendable one piece stretch cord to be threaded through the upper pulley system allowing proper usage.

The term "lower roller" refers to a component of the pulley system that allows the flexible and extendable one piece stretch cord to be threaded through the lower pulley system allowing proper usage.

The term "middle roller" refers to a component of the pulley system that allows the flexible and extendable one piece stretch cord to be threaded through the lower pulley system allowing proper usage.

A speed and power development system has a moveable sled with a front, a back, opposite the front, a first base side connected between the front and back, and a second base side connected between the front and back.

The system has a static non-extending stretch cord attached to the moveable sled which can secure to the subject's waist or upper torso.

The system has a horizontally oriented raised weight base secured over the moveable sled for supporting a plurality of removable weights 32A-B.

The speed and power development system has a first agility box mounted over the moveable sled. The agility box has a first wall and a second wall, both walls mounted perpendicular to the moveable sled. The agility box also has a removable lid 49 that moveably engages the first and second walls.

The speed and power development system has a first outside upper pulley system having a plurality of aligned first upper rollers mounted on the outside of the first wall.

The speed and power development system 8 also has a first outside lower pulley system having a plurality of aligned first lower rollers that are mounted on the outside surface of the first wall. The first outside upper pulley system is spaced apart from the first outside lower pulley system.

The speed and power development system has a first inside upper roller system with a plurality of aligned first inside upper rollers that are mounted on the inside surface of the first wall.

The speed and power development system also has a first inside lower roller system with a plurality of aligned second inside upper rollers that are mounted on the inside surface of the first wall.

The first inside upper roller system first inside lower roller system is spaced apart from the first inside lower roller system.

The speed and power development system has a first remote roller that is mounted to the moveable sled and spaced apart from the agility box.

The first lockable pulley system bracket is mounted to an interior wall of the agility box.

The first flexible and extendable one piece stretch cord extends from the first lockable pulley system bracket sequentially follows the path from the first inside upper roller 63A to the first inside lower roller to the first remote roller to the first aligned first lower roller and then a first aligned first upper rollers.

Next the first flexible and extendable one piece stretch cord sequentially alternates over additional aligned first lower and aligned first upper rollers and then extends a first stretch cord length from the agility box to a first harness.

The first harness can connects on or around a part of the subject targeted for speed and power development.

As the subject pulls the first flexible and extendable one piece stretch cord, the subject receives a first load of resistance causing a physiological change to the part of the subject. A second load of resistance is simultaneously received by the subject while pulling the moveable sled with the static non-extendable stretch cord.

In embodiments, the speed and power development system has a weight cylinder mounted perpendicular to the moveable sled on the horizontally oriented raised weight base. The cylinder can be used for aligning and attaching the plurality of removable weights.

In embodiments, the agility box of the speed and power development system has a first rod between the first and second walls on the back side of the agility box and a second rod between the first and second walls aligning upper rollers on a front side of the agility box. The first rod aligns the upper rollers on a back side of the agility box and the second rod aligns the upper rollers on a front side of the agility box.

In further embodiments, the agility box of the speed and power development system contains a storage box.

In embodiments, the speed and power development system has a plurality of sensors. Each sensor detects a different physiological change in a part of the subject and presents a reading wirelessly to a client device.

In further embodiments, the speed and power development system has a sensing system mounted to the agility box that is connected to the sensors.

The sensing system has a processor mounted to the agility box, a power supply connected to the processor, a computer readable media containing instructions that is connected to the processor.

The computer readable media contains instructions for the processor to calculate the following: distance travelled by the moveable sled, speed travelled by the subject pulling the moveable sled, force experienced by the subject while moving the movable base, the stride length of the subject, and stride frequency of the subject.

The plurality of sensors transmit the data received to the processor for processing.

In further embodiments, the sensors are selected from the group consisting of: a torque sensor, an angle and a position sensor, a pressure sensor, a temperature sensor, a motion sensor, a positioning locator, a heart rate sensor, a muscle electromyography sensor, and a camera.

In embodiments, the speed and power development system can have a second outside upper pulley system with a plurality of aligned second upper rollers that are mounted on the outside surface of the second wall.

A second outside lower pulley system with a plurality of aligned second lower rollers that are mounted on the outside the second wall.

The second outside upper pulley system is spaced apart from the second outside lower pulley system.

A second inside upper roller system with a plurality of aligned second inside upper rollers are mounted on the inside surface of the second wall.

A second inside lower roller system with a plurality of aligned second lower inside rollers are mounted to the inside surface of the second wall.

The second inside upper roller system is spaced apart from the second inside lower roller system.

A second remote roller is mounted to the moveable sled spaced apart from the agility box. A second lockable pulley system bracket mounted to the interior wall of the agility box.

A second flexible and extendable one piece stretch cord extends from the second lockable pulley system bracket and sequentially follows the path from the second inside upper roller to the second inside lower roller to the second remote roller to the first aligned second upper roller to the first aligned second lower roller and then alternating over additional aligned second upper and lower rollers.

A second flexible and extendable one piece stretch cord extends a second stretch cord length from the agility box to a second harness. The second harness connects on or around a part of the subject targeted for the speed and power development.

In embodiments, the speed and power development system has a plurality of first upper middle inside rollers and a plurality of first lower middle inside rollers mounted to the outside of the first wall. The first lower middle inside rollers are spaced apart from the plurality of first upper middle inside rollers.

The speed and power development system also has a third remote roller mounted to the moveable sled spaced apart from the agility box. A third lockable pulley system bracket is mounted to an interior wall of the ability box.

A third flexible and extendable one piece stretch cord extends from the third lockable pulley system bracket and sequentially follows the path from the first upper middle inside rollers to the first lower middle inside rollers to the third remote roller 370 to the aligned second inside upper rollers to the aligned first inside upper rollers 63A and alternating over additional aligned first upper and lower inside rollers.

A third flexible and extendable one piece stretch cord extends a third stretch cord length from the agility box to a third harness. The third harness connects on or around a part of the subject targeted for speed and power development.

In embodiments, the speed and power development system has a plurality of second upper middle inside rollers and second lower middle inside rollers mounted to the outside of the second wall. The second lower middle inside rollers are spaced apart from the plurality of second upper middle inside rollers.

The speed and power development system also has a fourth remote roller mounted to the moveable sled spaced apart from the agility box. A fourth lockable pulley system bracket 80*d* mounted to an interior wall of the ability box.

A fourth flexible and extendable one piece stretch cord extends from the fourth lockable pulley system bracket and sequentially follows the path to the second upper middle inside rollers to second lower middle inside rollers to the fourth remote roller to the aligned second lower inside rollers a to the aligned second inside upper rollers and alternating over additional aligned second upper and lower inside rollers.

A fourth flexible and extendable one piece stretch cord extends a fourth stretch cord length from the agility box to a fourth harness. The fourth harness connects on or around a part of the subject targeted for speed and power development.

In embodiments, the moveable sled of the speed and power development system has a hollow tubular frame.

In embodiments, the moveable sled of the speed and power development system has a plurality of handles.

In embodiments, the speed and power development system has a second agility box mounted over the moveable sled opposite the first agility box.

In embodiments, the speed and power development system has front and rear ends that both curve up from one to three inches on each of the front and back.

In embodiments, the speed and power development system has a removable drive arm engages the horizontally oriented raised weight base of the movable sled.

The removable drive arm is made up of a base extension, an angled one piece extension, a welded point, a drop flat bar, and a forked piece.

The base extension is connected to the horizontally oriented raised weight base. The one piece extension extends upwardly from the base extension. The welded point is connected to the angled one piece extension and connected at the opposite end to the base extension. The drop flat bar extends from the weld point and is adjustably mounted to the welded point. The forked piece extends from the drop flat bar and has padding configured to allow a subject to push the sled with a head of the subject between the padding.

Turning now to the Figures, FIG. 1 depicts a perspective view of the speed and power development system.

The speed and power development system 8 has a horizontally oriented raised weight base 30 secured to and horizontally oriented on the moveable sled 10.

The horizontally oriented raised weight base 30 has a weight cylinder 31 that can be used to support a plurality of removable weights. The plurality of removable weights are added to increase resistance of the moveable sled to the subject.

The speed and power development system 8 has an agility box 40 secured to the moveable sled 10. The agility box has a first wall 42 and a second wall, (not shown) wherein both walls are mounted perpendicular to a plane of the moveable sled.

The first and second walls align with each other.

The agility box 40 has a first rod 43 mounted between the first and second walls aligning the upper rollers on a back side of the agility box.

The agility box 40 has a removable lid 49 which engages both the first and second walls.

A first remote roller 70 and a third remote roller 370 are mounted to one side of the moveable sled 10.

A second remote roller 170 and a fourth remote roller 470 are mounted to an opposite side of the moveable sled 10.

A first flexible and extendable one piece stretch cord 71A extends from a first lockable pulley system bracket mounted to the agility box then sequentially through the upper and lower middle rollers then around the first remote roller 70 and then sequentially through additional upper and lower rollers to extend a preset length and connects on or around a part of a subject targeted for speed and power development.

A second flexible and extendable one piece stretch cord 71B extends from the agility box to the second remote roller 170 and then sequentially through a second outside lower pulley system and second outside upper pulley system and then connects on or around a part of the subject targeted for speed and power development.

A third flexible and extendable one piece stretch cord 71C can also be used.

A handle 602A is shown integrally attached to the back of the moveable sled 10. The handle can be used to aid in transport or to move the speed and power development system during use.

Figure 2:
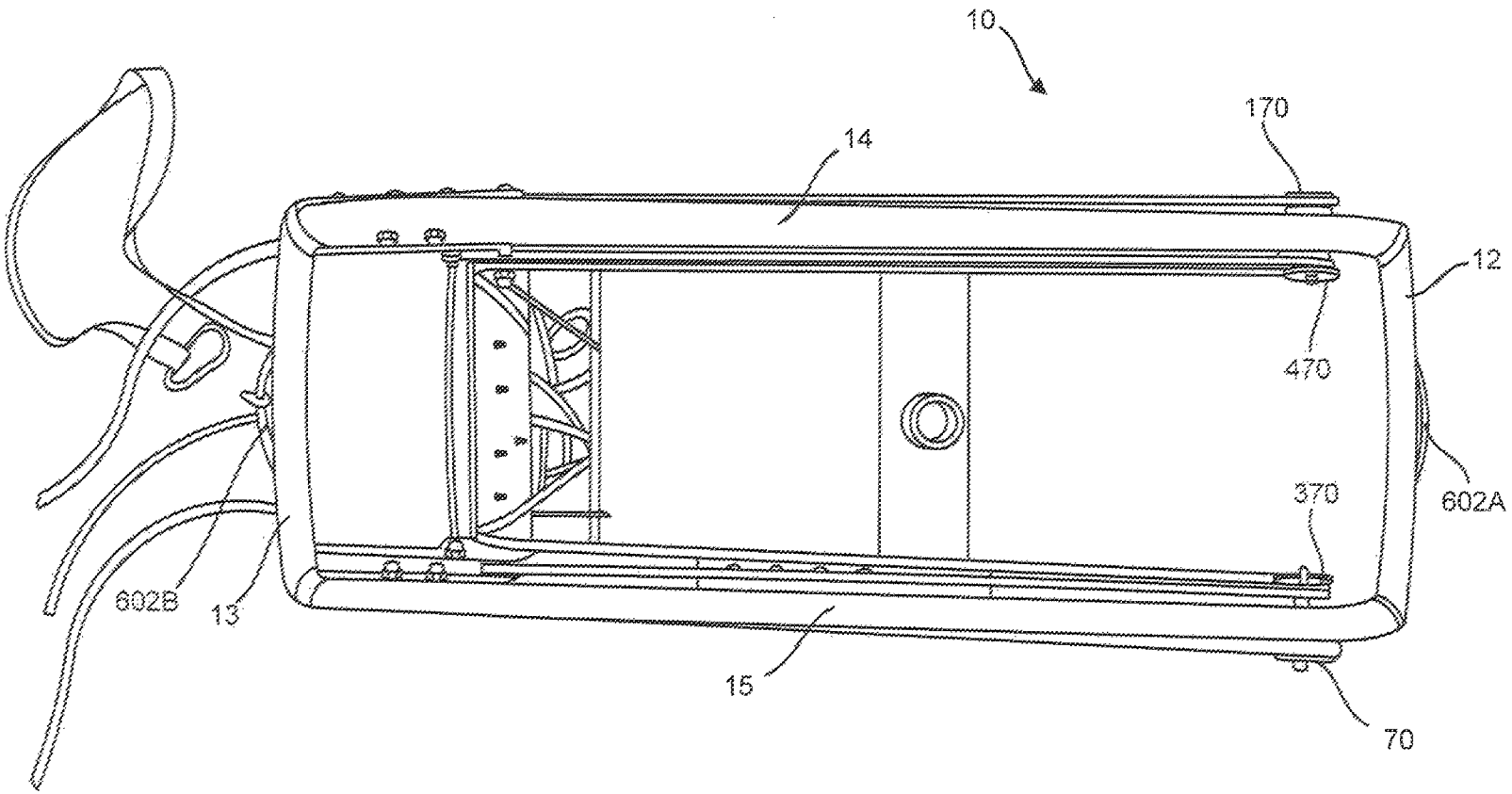
FIG. 2 depicts a bottom view of the speed and power development system.

FIG. 2 depicts a bottom view of the speed and power development system providing detail on the moveable sled 10.

The movable sled 10 has a front 13, a back 12 opposite the front.

The moveable sled has a first side base 14 connected between the front and back, and a second side base 15 connected between the front and back opposite the first base side.

The front 13 and back 12 are opposite each other.

The first and second base sides are each attached at one end to the front and both attached at their respective other ends to the back of the sled.

The first remote roller 70 is mounted on the outside of the second base side 15. The second remote roller 170 is mounted on the outside of the first base side 14.

A third remote roller 370 is mounted on the inside of the second base side 15.

A fourth remote roller 470 is mounted on the inside of the first base side 14.

The remote rollers can be made from material, including nylon, metal, or a hard plastic.

The remote rollers can have a diameter from 1 inch to 4 inches.

The remote rollers can contain grooves on the perimeter of the rollers for containing the flexible and extendable one piece stretch cords.

A handle 602A is shown integrally attached to the back 12 of the moveable sled 10. Another handle 602B is shown integrally attached to the front 13 of the moveable sled 10.

Figure 3:
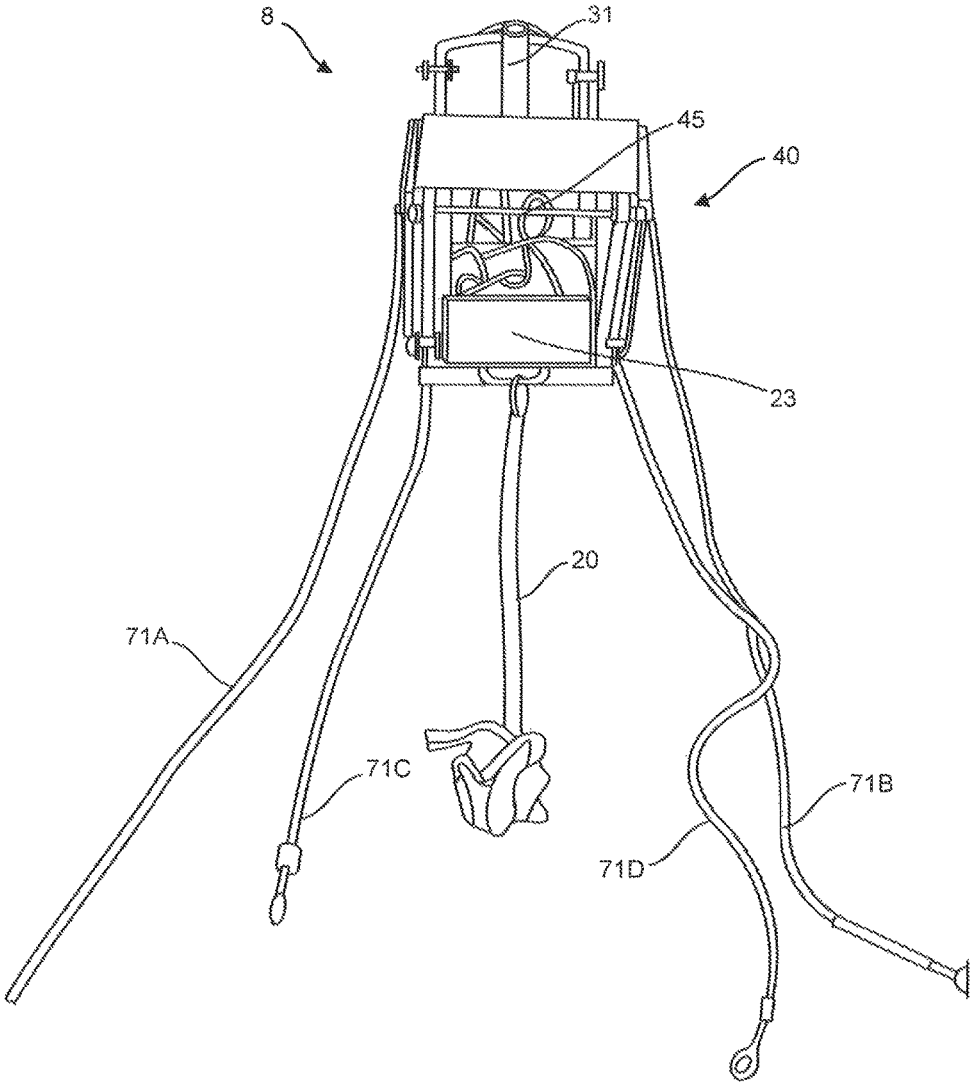
FIG. 3 depicts front perspective view of a four flexible stretch cord embodiment of the speed and power development system.

FIG. 3 depicts front perspective view of a four flexible stretch cord embodiment of the speed and power development system.

The speed and power development system 8 is shown with a static non-extending stretch cord 20 attached to the moveable sled.

The speed and power development system 8 is shown with an agility box 40 mounted near the front of the moveable sled. The agility box has a storage box 23. The storage box 23 can be used to store additional stretch cords or the subject's belongings.

A second rod 45 is located on the front side of the agility box 40 between the first and second walls of the agility box. The second rod 45 aligns the upper rollers on the front side of the agility box.

The weight cylinder 31 is attached to the horizontally oriented raised weight base. The weight cylinder is capable of supporting a plurality of removable weights, such as various sizes of plates, to increase resistance to the subject as the subject pulls the moveable sled.

A first flexible and extendable one piece stretch cord 71A is shown extending from the first outside upper pulley system mounted on an outside surface of the first wall.

A second flexible and extendable one piece stretch cord 71B is shown extending from a second outside upper pulley system mounted on an outside surface of the second wall.

A third flexible and extendable one piece stretch cord 71C is shown extending from a lower portion of the agility box.

A fourth flexible and extendable one piece stretch cord 711) is shown extending from a lower portion of an opposite side of the agility box.

Figure 4:
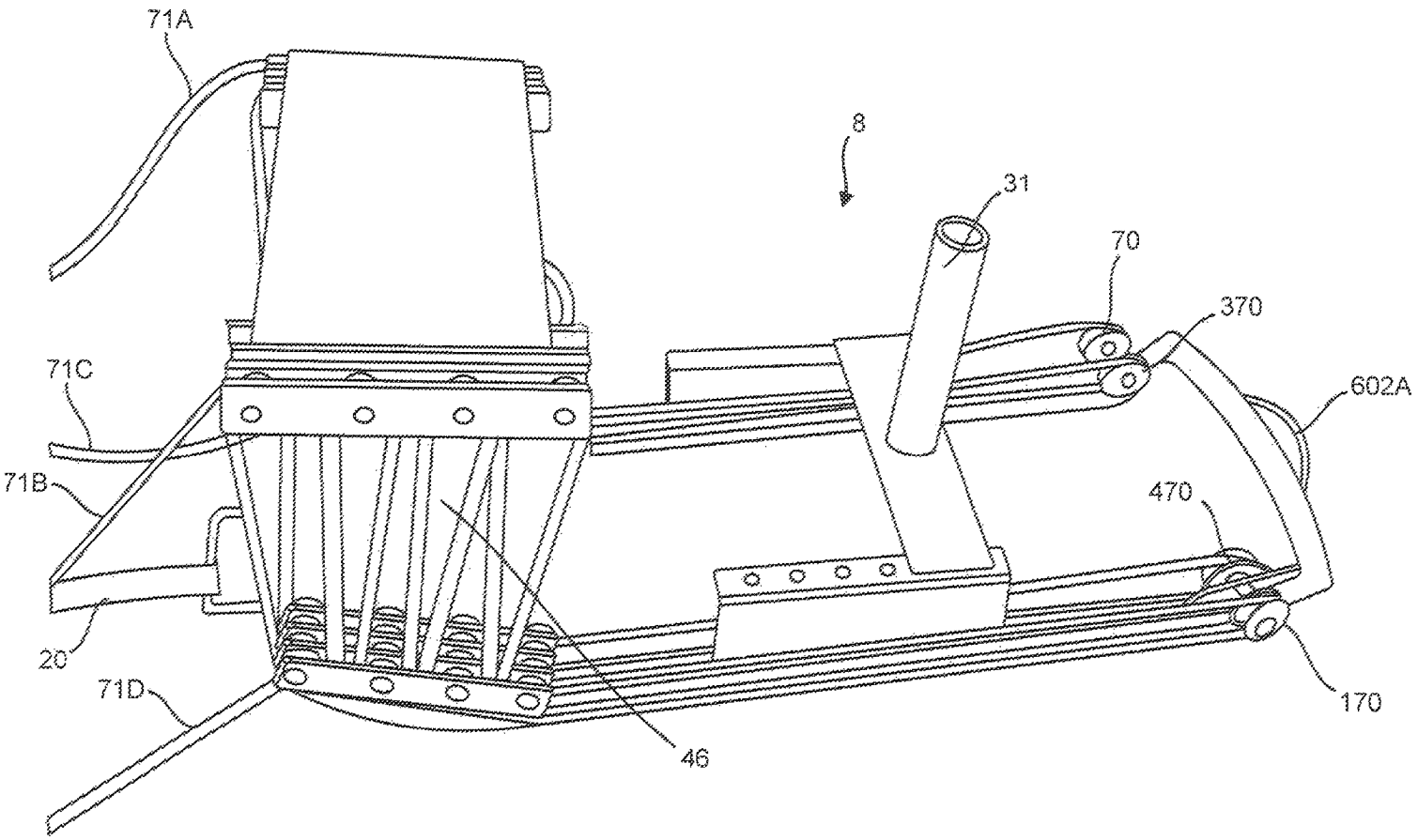
FIG. 4 depicts a side view of the speed and power development system.

FIG. 4 depicts a side view of the speed and power development system 8.

The moveable sled is shown with the agility box positioned near the front of the moveable sled.

This FIG. 4 depicts the second wall 46 of the agility box.

The weight cylinder 31 is shown attached to a narrow embodiment of the horizontally oriented raised weight base.

A first remote roller 70 and a third remote roller 370 are shown mounted to the second base side of the moveable sled. A second remote roller 170 and a fourth remote roller 470 are mounted to the first base side of the moveable sled.

A handle 602A is shown integrally attached to the back of the moveable sled.

Four flexible and extendable one piece stretch cords 71A, 71B, 71C, and 71D are depicted along with static non-extending stretch cord 20. The static non-extending stretch cord 20 can be seat belt webbing or a woven nylon material that is easily cleaned.

Figure 5:
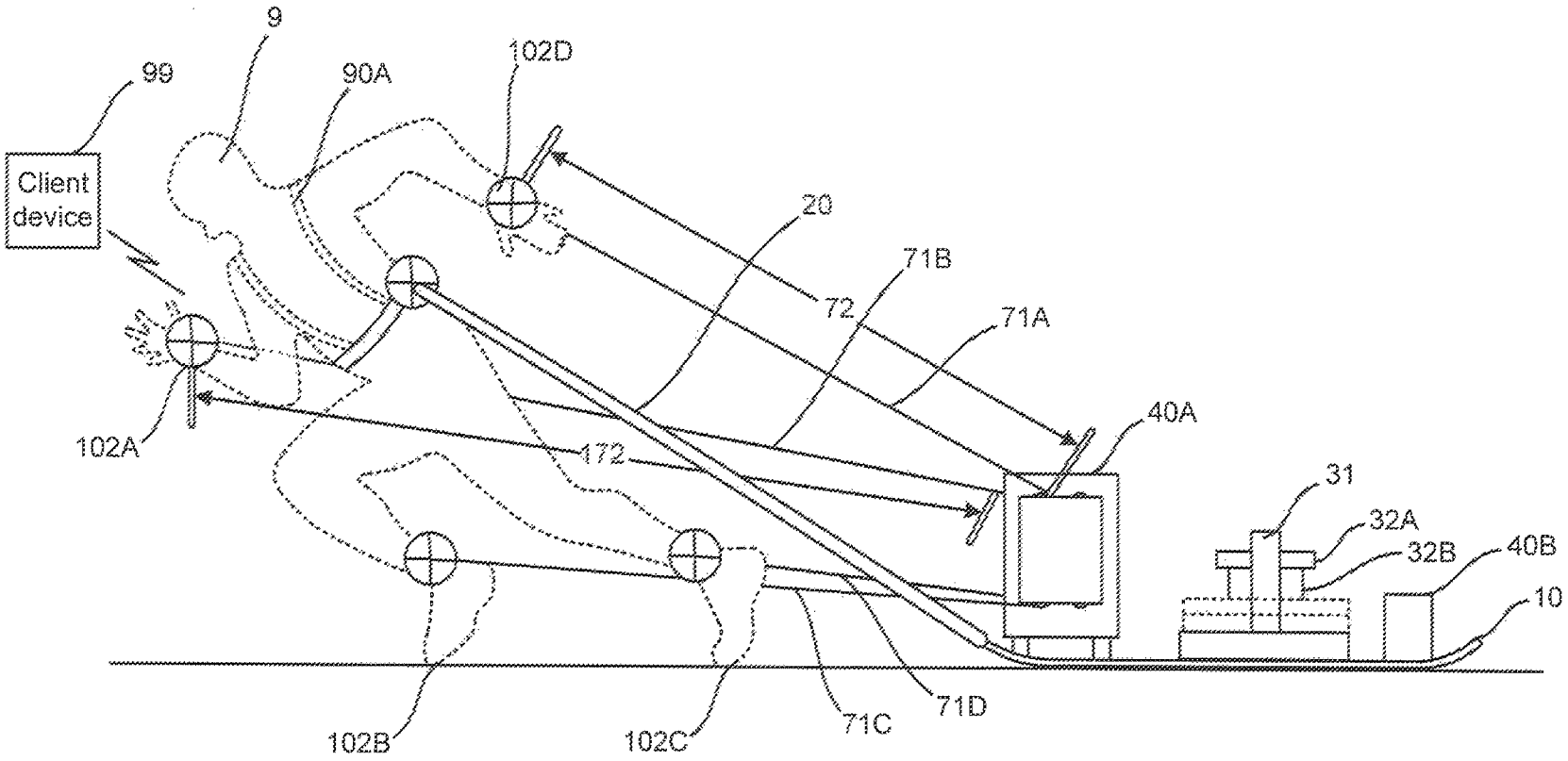
FIG. 5 depicts a side view of a four flexible stretch cord embodiment of the speed and power development system attached to a subject.

FIG. 5 depicts a side view of a four flexible and extendable one piece stretch cords 71A, 71B, 71C, and 71D attached to a subject.

The subject 9 is attached to the speed and power development system by a static non-extending stretch cord 20.

In addition, the subject 9 is attached to the speed and power development system by a first harness 90A connected to the static non-extending stretch cord 20, and four other harnesses each with a sensor engaging one of the flexible and extendable one piece stretch cords.

The first flexible and extendable one piece stretch cord 71A then extends a first stretch cord length 72 measured from the agility box 40*a* to a harness on the wrist of the subject.

The second flexible and extendable one piece stretch cord 71B extends a second stretch cord length 172 measured from the agility box 40A to a harness on another wrist of the subject 9.

The third flexible and extendable one piece stretch cord 71C then extends a stretch cord length measured from the agility box to a harness on an ankle of the subject.

The fourth flexible and extendable one piece stretch cord 71D extends a stretch cord length measured from the agility box to a harness on another ankle of the subject.

FIG. 5 shows a plurality of sensors 102A-D.

Each sensor is used to detect different physiological changes in a part of the subject while using the speed and power development system 8.

The sensors can be a torque sensor, an angle and a position sensor, a pressure sensor, a temperature sensor, a motion sensor, a positioning locator, a heart rate sensor, a muscle electromyography sensor, and a camera. The readings from the sensors can be wirelessly transmitted for display on a client device 99.

FIG. 5 shows the weight cylinder 31 attached to the horizontally oriented raised weight base on the moveable sled 10 which is depicted with a non-planar back end, slightly raised a few inches. The weight cylinder is capable of supporting a plurality of removable weights 32A, 32B, such as 5 pound weights, 2 pound weights and similar weights to increase resistance to the subject as the subject pulls the moveable sled.

The speed and power development system shown in the figure has a two agility boxes, 40A, and 40B mounted over the moveable sled 10.

Figure 6:
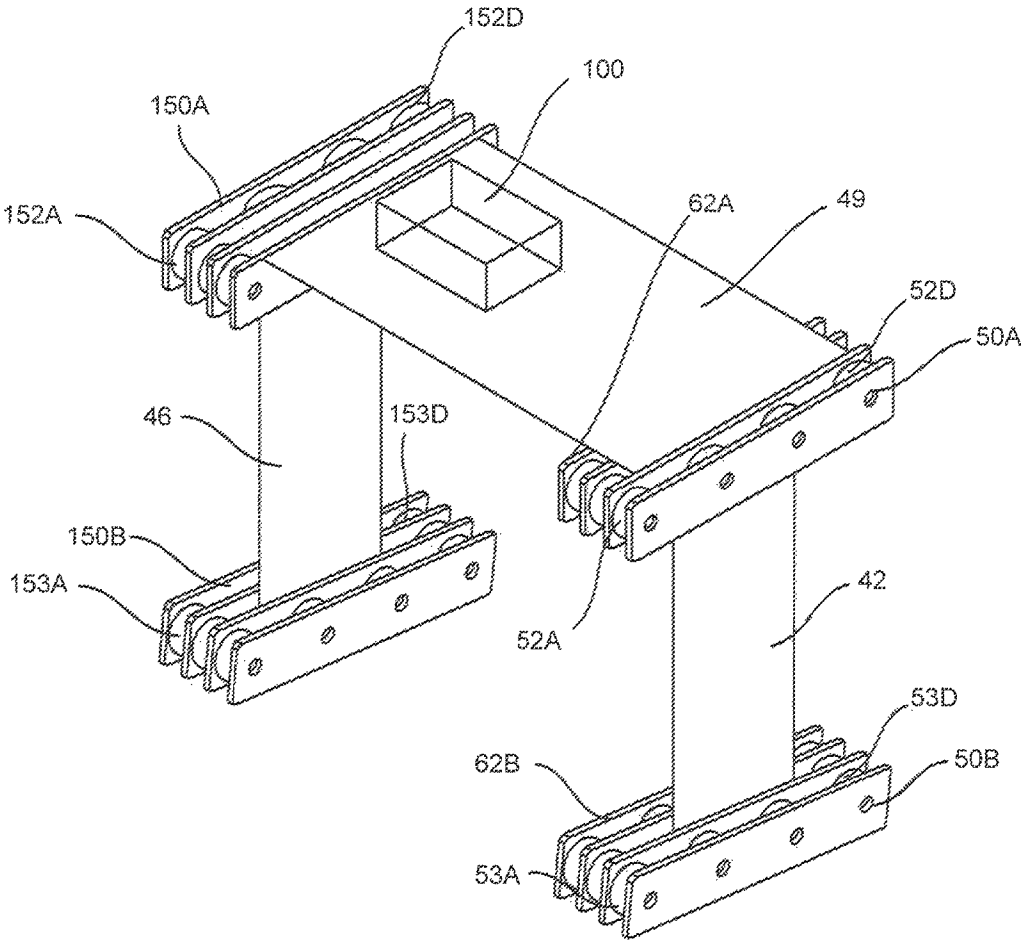
FIG. 6 is a detailed view of an agility box according to an embodiment.

FIG. 6 is a detailed view of an agility box according to an embodiment.

The agility box has a first wall 42 and a second wall 46, both walls mounted perpendicular to the moveable sled.

The first and second walls are aligned with each other.

The agility box has a removable lid 49 which engages both the first and second walls simultaneously.

The speed and power development system has a first outside upper pulley system 50A made up of a plurality of aligned first upper rollers 52A-D mounted on the outside surface of the first wall 42.

The first outside lower pulley system 50B is made up of a plurality of aligned first lower rollers 53A-D mounted on the outside surface of the first wall 42 and spaced apart from the first outside upper pulley system 50A.

Figure 7:
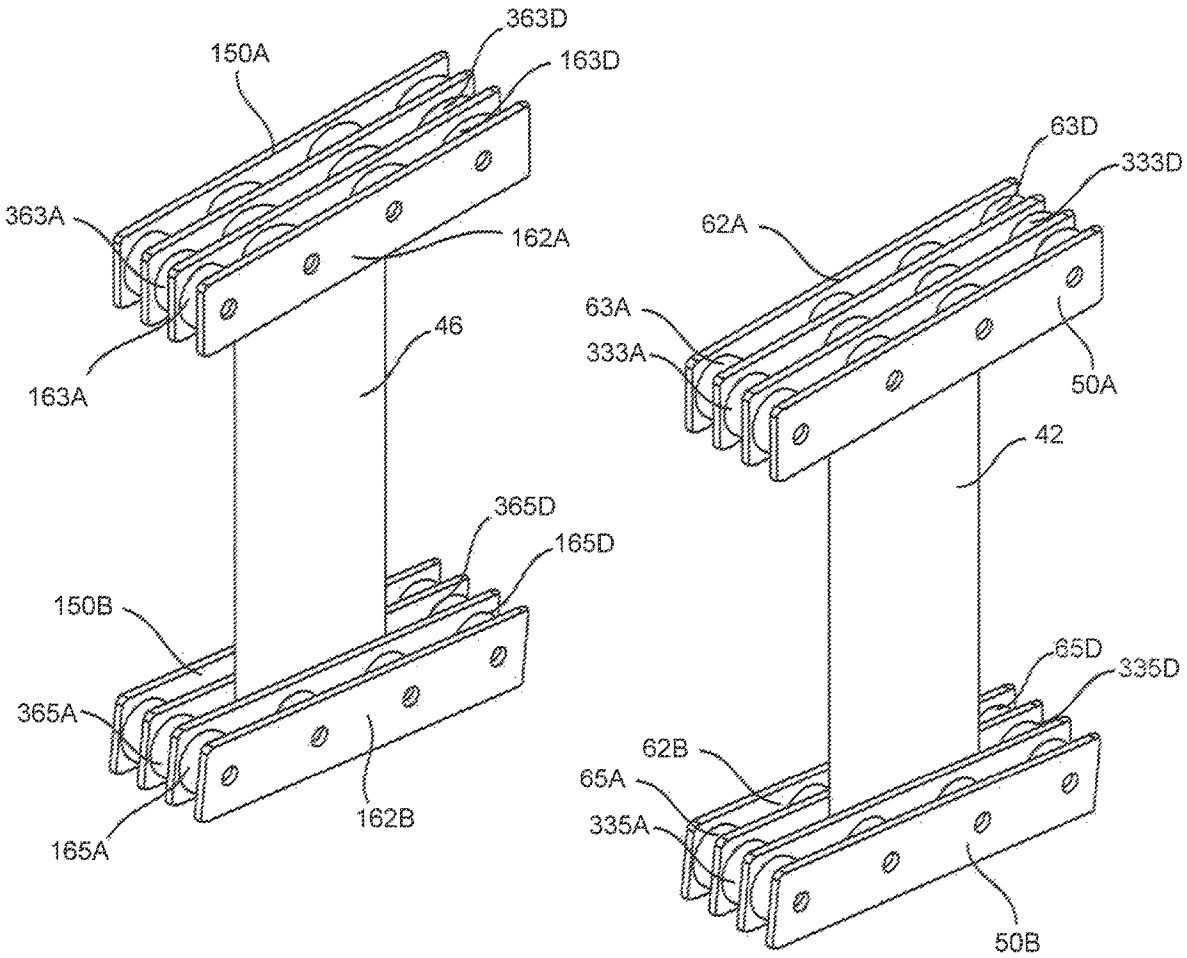
FIG. 7 depicts a four pulley system embodiment of the invention with two pulley systems attached to a first wall and two pulley systems attached to a second wall.

The figure shows a first inside upper roller system 62A comprising a plurality of aligned first inside upper rollers 63A-D mounted on an inside surface of the first wall 42 as shown in FIG. 7.

Returning to FIG. 6, the first inside lower roller system 62B is made up of a plurality of aligned first inside lower rollers 65A-D mounted on an inside surface of the first wall 42, these rollers are also depicted in FIG. 7.

Returning to FIG. 6, a sensing system 100 is depicted mounted to the lid 49 of the agility box. The sensing system communicates with the sensors 102A-D depicted in earlier Figures.

The speed and power development system is shown with a second outside upper pulley system 150A made up of a plurality of aligned second upper rollers 152A-D mounted on an outside surface of the second wall 46.

The speed and power development system is also shown with a second outside lower pulley system 150B having aligned second lower rollers 153A-D mounted on an outside surface of the second wall 46 and spaced apart from the second outside upper pulley system 150A.

FIG. 7 depicts additional detail of the pulley systems in a four pulley system embodiment of the invention with two pulley systems attached to a first wall and two pulley systems attached to a second wall.

The speed and power development system has a first outside upper pulley system 50A mounted on the outside surface of the first wall 42 and a first outside lower pulley system 50B mounted on the outside surface of the first wall 42 and spaced apart from the first outside upper pulley system 50A.

The figure shows a first inside upper roller system 62A with a plurality of aligned first inside upper rollers 63A-D mounted on an inside surface of the first wall 42 and a first inside lower roller system 62B with a plurality of aligned first inside lower rollers 65A-D mounted on an inside surface of the first wall 42.

The first upper middle inside rollers 333A-D and first lower middle inside rollers 335A-D are shown are mounted on opposite ends of the first wall 42.

The second outside upper pulley system 150A is mounted on an outside surface of the second wall 46 and the second outside lower pulley system 150B is mounted on the outside surface of the second wall 46 in a spaced apart relationship.

A second inside upper roller system 162A is shown made up of a plurality of aligned third inside upper rollers 163A-D) and the second inside upper roller system is mounted on an inside surface of the second wall 46.

In addition, a second inside lower roller system 162B, is mounted on an inside surface of the second wall, having a plurality of aligned third lower inside rollers 165A-D and mounted an inside surface of the second wall 46 spaced apart from the second inside upper roller system 162A.

The speed and power development system is shown with second upper middle inside rollers 363A-D and second lower middle inside rollers 365A-D are shown, each mounted on opposite ends of the second wall.

Figure 8:
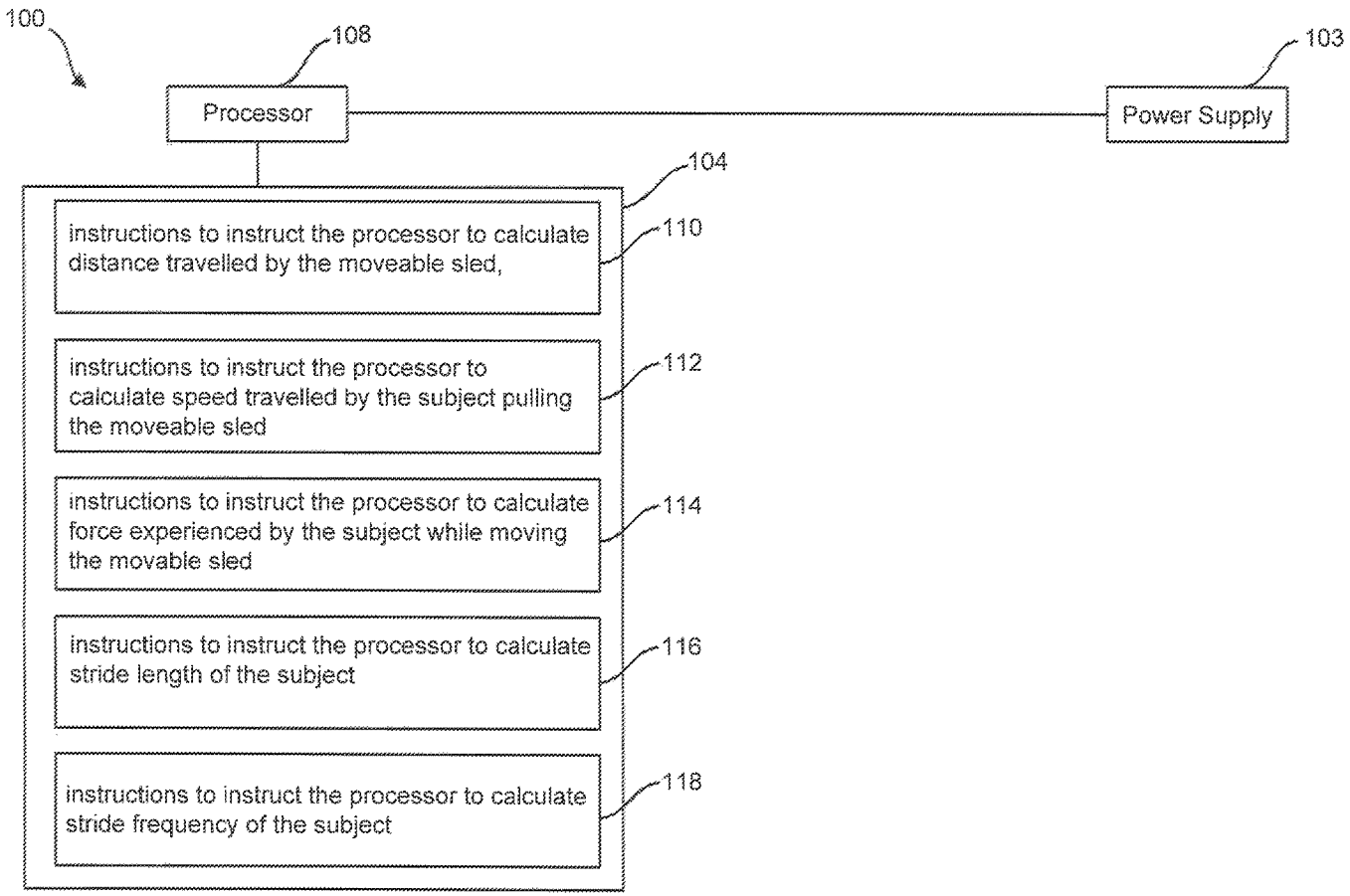
FIG. 8 is a diagram of the sensing system of the speed and power development system.

FIG. 8 is a diagram of the sensing system of the speed and power development system.

The sensing system 100 has a processor 102 which can be a computer with memory, such as a laptop, mounted to the agility box and electrically connected to a power supply 103. The processor 102 communicates with a computer readable media 104 and contains several sets of instructions.

The computer readable media 104 contains instructions to instruct the processor to: instruct the processor to calculate distance travelled by the moveable sled as instruction 110, instruct the processor to calculate speed travelled by the subject pulling the moveable sled as instruction 112, instruct the processor to calculate force experienced by the subject while moving the movable sled as instruction 114, instruct the processor to calculate stride length of the subject as instructions 116, and instruct the processor to calculate stride frequency of the subject as instructions 118.

Upon receipt of the data from the sensors worn by the subject, the processor 102 processes the data and transmits the data to the client device shown in FIG. 5.

FIG. 9 is a side view of the speed and power development system using four flexible and extendable one piece stretch cords 71A-D and a removable drive arm 500.

The moveable sled of the speed and power development system is shown with a weight cylinder 31 capable of supporting a plurality of removable weights 32A, 32B which is secured to the horizontally oriented raised weight base 30 which is secured to the moveable sled.

A removable drive arm 500 engages the weight cylinder 31. The weight cylinder 31 is shown attached to a narrow embodiment of the horizontally oriented raised weight base 30. The weight cylinder is capable of supporting a plurality of removable weights 32A, 32B.

The removable drive arm 500 is made up of a base extension 502, an angled one piece extension 504 extending upwardly from the base extension at an angle from 40 degrees to 90 degrees. The angled one piece extension can be hard plastic.

A welded point 506 engages the angled one piece extension 504 and has numerous holes allowing for adjustability of the angle of a drop flat bar 508.

The drop flat bar can be made from hard plastic or metal and extends from the weld point to a forked piece 510.

The forked piece 510 can include padding configured to allow a subject to push the moveable sled with a head of the subject between the padding.

The figure shows the subject 9 pushing the speed and power development system while attached to four harnesses 90C-90F.

Each harness is attached to one of the flexible and extendable one piece stretch cord 71A-D respectively.

Two sensors 102A and 102D are shown attached to the subject 9 to transmit the data on bodily functions to the client device.

The third stretch cord length 272 is depicted as a length measured from where the third flexible and extendable one piece stretch cord exits the agility box to one of the harnesses on the subject. The length can be from 1 foot to 6 feet.

The fourth stretch cord length 372 is depicted as a length measured from where the fourth flexible and extendable one piece stretch cord exits the agility box to a harness on the subject.

FIG. 10 depicts a plurality of lockable pulley system brackets of the speed and power development system.

Four lockable pulley system brackets 80A-D are shown mounted to an interior side wall of the agility box 40.

Example 1

The patient will using the flexible and extendable one piece stretch cord while in physical therapy to pull a flexible and extendable one piece stretch cord load of resistance simultaneously with pulling the moveable sled with the static non-extendable stretch cord. The patient's muscles are healed as a result of using the system.

A speed and power development system 8 for a subject has a moveable sled 10 with a front 13, back 12, first base side 14, and second base side 15 made from aluminum.

A static non-extending stretch cord 20 can be attached to the front handle on the moveable sled 10. The static non-extending stretch cord secures to the waist of the subject 9.

The moveable sled has a horizontally oriented raised weight base 30 secured over the moveable sled in a spaced apart relationship for supporting a plurality removable weights 32A-B, such as 2 45 pound weighted pates.

The moveable sled has an agility box 40 welded to the moveable sled. The agility box, made of aluminum has a first wall 42, a second wall 46, and a removable lid 49. The agility box can be used to store the personal belongings of the subject.

The speed and power development system 8 has a first outside upper pulley system 50A with four aligned first upper rollers 52A-D mounted on the outside of the first wall 42.

The speed and power development system 8 also has a first outside lower pulley system 50B with four aligned first lower rollers 53A-D mounted on the outside of the first wall. The first outside upper pulley system 50A and first outside lower pulley system 50B are spaced apart on opposite ends of the first wall.

Mounted on the inside of the first wall is a first inside upper roller system 62A with four aligned first inside upper rollers 63A-D and a first inside lower roller system 62B with four aligned first inside lower rollers 65A-D. The first inside upper roller system 62A and the first inside lower roller system 62B are spaced apart on opposite ends of the first wall 42.

The rollers are polyurethane guide rollers.

The speed and power development system 8 has a first remote roller 70 mounted to the second base side of the moveable sled spaced apart from the agility box 40.

Located inside the agility box is a first lockable pulley system bracket 80A, a cam cleat, mounted to the interior wall of the agility box 40.

The speed and power development system 8 has a 10 foot long first flexible and extendable one piece stretch cord 71A extending from the first lockable pulley system bracket 80A, a cam cleat, sequentially to the first inside upper roller 63A, the first inside lower roller 65A, the first remote roller 70, a first aligned first lower roller 53A and then a first aligned first upper rollers 52A and then sequentially alternating over additional aligned first lower and aligned first upper rollers.

The first flexible and extendable one piece stretch cord 71A extends a first stretch cord length 72 from the agility box to a first harness 90 worn by the subject 9. The first harness connects to the arm of the subject for rehabilitation purposes.

As the subject pulls the first flexible and extendable one piece stretch cord 71A, a first load of resistance causes a physiological change to the arm of the subject. The subject simultaneously receives a second load of resistance while pulling the moveable sled with the static non-extendable stretch cord.

Example 2

A speed and power development system 8 for a subject has a moveable sled 10 with a front 13, back 12, first base side 14, and second base side 15 made from fiberglass.

A static non-extending stretch cord 20 can be attached directly to the moveable sled 10. The static non-extending stretch cord secures to the waist of the subject 9.

The moveable sled has a horizontally oriented raised weight base 30 secured over the moveable sled in a spaced apart relationship for supporting a plurality of removable weights 32A-B, such as sandbags.

The moveable sled has an agility box 40 bolted to the moveable sled. The agility box, made of steel has a first wall 42, a second wall 46, and a removable lid 49. The agility box can be used to store additional flexible and extendable one piece stretch cords to provide additional resistance.

The speed and power development system 8 has a first outside upper pulley system 50A with three aligned first upper rollers 52A-D mounted on the outside of the first wall 42.

The speed and power development system 8 also has a first outside lower pulley system 50B with three aligned first lower rollers 53A-D mounted on the outside of the first wall. The first outside upper pulley system 50A and first outside lower pulley system 50B are spaced apart on opposite ends of the first wall.

Mounted on the inside of the first wall is a first inside upper roller system 62A with three aligned first inside upper rollers 63A-D and a first inside lower roller system 62B with three aligned first inside lower rollers 65A-D. The first inside upper roller system 62A and the first inside lower roller system 62B are spaced apart on opposite ends of the first wall 42.

The rollers are plastic ball bearing rollers.

The speed and power development system 8 has a first remote roller 70 mounted to the second base side of the moveable sled spaced apart from the agility box 40.

Located inside the agility box is a first lockable pulley system bracket 80A, is a jam cleat, mounted to the interior wall of the agility box 40.

The speed and power development system 8 has a 50 foot long first flexible and extendable one piece stretch cord 71A extending from the first lockable pulley system bracket 80A, an eyelet screw, sequentially to the first inside upper roller 63A, the first inside lower roller 65A, the first remote roller 70, a first aligned first lower roller 53A and then a first aligned first upper rollers 52A and then sequentially alternating over additional aligned first lower and aligned first upper rollers.

The first flexible and extendable one piece stretch cord 71A extends a first stretch cord length 72 from the agility box to a first harness 90 worn by the subject 9. The first harness connects to the arm of the subject for strength purposes.

As the subject pulls the first flexible and extendable one piece stretch cord 71A, a first load of resistance causes a physiological change to the arm of the subject. The subject simultaneously receives a second load of resistance while pulling the moveable sled with the static non-extendable stretch cord.

Example 3

A speed and power development system 8 for a subject has a moveable sled 10 with a front 13, back 12, first base side 14, and second base side 15 made from carbon fiber.

A static non-extending stretch cord 20 can be attached directly to the moveable sled 10. The static non-extending stretch cord secures to the waist of the subject 9.

The moveable sled has a horizontally oriented raised weight base 30 secured over the moveable sled in a spaced apart relationship for supporting a plurality of removable weights 32A, 32B, such as dumbbells.

The moveable sled has an agility box 40 bolted to the moveable sled. The agility box, made of plastic has a first wall 42, a second wall 46, and a removable lid 49. The agility box can be used to store additional flexible and extendable one piece stretch cords to provide additional resistance.

The speed and power development system 8 has a first outside upper pulley system 50A with six aligned first upper rollers 52A-D mounted on the outside of the first wall 42.

The speed and power development system 8 also has a first outside lower pulley system 50B with six aligned first lower rollers 53A-D mounted on the outside of the first wall. The first outside upper pulley system 50A and first outside lower pulley system 50B are spaced apart on opposite ends of the first wall.

Mounted on the inside of the first wall is a first inside upper roller system 62A with six aligned first inside upper rollers 63A-D and a first inside lower roller system 62B with six aligned first inside lower rollers 65AD. The first inside upper roller system 62A and the first inside lower roller system 62B are spaced apart on opposite ends of the first wall 42.

The rollers are needle roller bearings.

The speed and power development system 8 has a first remote roller 70 mounted to the second base side of the moveable sled spaced apart from the agility box 40.

Located inside the agility box is a first lockable pulley system bracket 80A, is a cam cleat, mounted to the interior wall of the agility box 40.

The speed and power development system 8 has a 200 foot long first flexible and extendable one piece stretch cord 71A extending from the first lockable pulley system bracket 80A, the cam cleat, sequentially to the first inside upper roller 63A, the first inside lower roller 65A, the first remote roller 70, a first aligned first lower roller 53A and then a first aligned first upper rollers 52A and then sequentially alternating over additional aligned first lower and aligned first upper rollers.

The first flexible and extendable one piece stretch cord 71A extends a first stretch cord length 72 from the agility box to a first harness 90 worn by the subject 9. The first harness connects to the leg of the subject for fast twitch muscle training.

As the subject pulls the first flexible and extendable one piece stretch cord 71A, a first load of resistance causes a physiological change to the leg of the subject. The subject simultaneously receives a second load of resistance while pulling the moveable sled with the static non-extendable stretch cord.

What is claimed is:

1. A speed and power development system for a subject comprising:

a. a moveable sled comprising
   (i) a front;
   (ii) a back opposite the front;
   (iii) a first base side connected between the front and back; and
   (iv) a second base side connected between the front and back opposite the first base side;

b. a static non-extending stretch cord attached to the moveable sled, the static non-extending stretch cord configured to secure to at least one of: a waist and an upper torso of a subject;

c. a horizontally oriented raised weight base secured over the moveable sled in a spaced apart relationship for supporting a plurality of removable weights mounted to the horizontally oriented raised weight base, the horizontally oriented raised weight base configured to align and attach the plurality of removable weights on the horizontally oriented raised weight base;

d. a first agility box mounted over the moveable sled, the agility box comprising:
   (i) a first wall, the first wall mounted perpendicular to the moveable sled;
   (ii) a second wall, the second wall aligned with the first wall and the second wall mounted perpendicular to the moveable sled; and
   (iii) a removable lid moveably engaging the first wall and the second wall;

e. a first outside upper pulley system comprising a plurality of aligned first upper rollers mounted on an outside surface of the first wall;

f. a first outside lower pulley system comprising a plurality of aligned first lower rollers mounted on an outside surface of the first wall and spaced apart from the first outside upper pulley system;

g. a first inside upper roller system comprising a plurality of aligned first inside upper rollers mounted on an inside surface of the first wall;

h. a first inside lower roller system comprising a plurality of aligned first inside lower rollers mounted on an inside surface of the first wall and spaced apart from the first inside upper roller system;

i. a first remote roller mounted to the moveable sled spaced apart from the agility box;

j. a first lockable pulley system bracket mounted to an interior wall of the agility box;

k. a first flexible and extendable one piece stretch cord extending from the first lockable pulley system bracket sequentially to one of the plurality of aligned first inside upper rollers % one of the plurality of aligned first inside lower roller, the first remote roller, a second one of the plurality of aligned first lower rollers and then to a second one of the plurality of aligned first upper rollers and then sequentially alternating over additional aligned first lower and aligned first upper rollers, then extending a first stretch cord length from the agility box to a first harness, wherein the first harness is configured to connect or around a part of the subject targeted for speed and power development; and the speed and development system being configured for an exercise wherein the subject pulls the first flexible and extendable one piece stretch cord receiving a first load of resistance causing a physiological change to the part of the subject while simultaneously receiving a second load of resistance while pulling the moveable sled with the static non-extendable stretch cord.

2. The speed and power development system of claim 1, wherein the horizontally oriented raised weight base comprises a weight cylinder mounted perpendicular to the moveable sled for aligning and attaching the plurality of removable weights.

3. The speed and power development system of claim 1, wherein the agility box has a first rod between the first and second walls aligning upper rollers on a back side of the agility box, and a second rod between the first and second walls aligning upper rollers on a front side of the agility box.

4. The speed and power development system of claim 3, wherein the agility box contains a storage box.

5. The speed and power development system of claim 1, comprising a plurality of sensors, wherein each sensor is configured to detect a different physiological change in a part of the subject while using the speed and power development system and presents a reading wirelessly to a client device.

6. The speed and power development system of claim 5, comprising a sensing system mounted to the agility box connected to the sensors, the sensing system comprising:

a. a processor mounted to the agility box;
b. a power supply connected to the processor;
c. a computer readable media connected to the processor, the computer readable media containing:
(i) an instruction to instruct the processor to calculate distance travelled by the moveable sled,
(ii) an instruction to instruct the processor to calculate speed travelled by the subject pulling the moveable sled;
(iii) an instruction to instruct the processor to calculate force experienced by the subject while moving the movable sled;
(iv) an instruction to instruct the processor to calculate stride length of the subject; and
(v) an instruction to instruct the processor to calculate stride frequency of the subject, and wherein the sensors transmit data to the processor for processing.

7. The speed and power development system of claim 5, wherein the plurality of sensors are selected from the group consisting of: a torque sensor, an angle and a position sensor, a pressure sensor, a temperature sensor, a motion sensor, a positioning locator, a heart rate sensor, a muscle electromyography sensor, and a camera.

8. The speed and power development system of claim 1, further comprising:
a. a second outside upper pulley system comprising a plurality of aligned second upper rollers mounted on an outside surface of the second wall;
b. a second outside lower pulley system comprising a plurality of aligned second lower rollers mounted on an outside surface of the second wall and spaced apart from the second outside upper pulley system;
c. a second inside upper roller system comprising a plurality of aligned third inside upper rollers mounted on an inside surface of the second wall;
d. a second inside lower roller system comprising a plurality of aligned third lower inside rollers mounted an inside surface of the second wall and spaced apart from the second inside upper roller system;
e. a second remote roller mounted to the moveable sled spaced apart from the agility box;
f. a second lockable pulley system bracket mounted to an interior wall of the agility box;
g. a second flexible and extendable one piece stretch cord extending from the second lockable pulley system bracket sequentially to one of the plurality of third inside upper roller, one of the plurality of aligned third lower inside roller, the second remote roller, one of the plurality of aligned second lower rollers and then to one of the plurality of aligned second upper rollers and then alternating over additional aligned second lower and upper rollers, then extending a second stretch cord length from the agility box to a second harness, wherein the second harness is configured to connect on or around a part of the subject targeted for the speed and power development.

9. The speed and power development system of claim 1 comprising:
a. a plurality of first upper middle inside rollers mounted to an outside of the first wall;
b. a plurality of first lower middle inside rollers mounted to an outside of the first wall spaced apart from the plurality of first upper middle inside rollers;
c. a third remote roller mounted to the moveable sled spaced apart from the agility box;
d. a third lockable pulley system bracket mounted to an interior wall of the agility box;
e. a third flexible and extendable one piece stretch cord extending from the third lockable pulley system bracket sequentially to the first upper middle inside rollers, to the first lower middle inside rollers, the third remote roller, one of the plurality of aligned first inside upper rollers, one of the plurality of aligned first lower inside rollers and alternating over additional aligned first inside upper rollers and lower inside rollers, then extending a third stretch cord length from the agility box to a third harness, wherein the third harness is configured to connect on or around a part of the subject targeted for speed and power development.

10. The speed and power development system of claim 1, comprising:
a. a plurality of second upper middle inside rollers mounted to the outside of the second wall;
b. a plurality of second lower middle inside rollers mounted to the outside of the second wall spaced apart from the plurality of second upper middle inside rollers;
c. a fourth remote roller mounted to the moveable sled spaced apart from the agility box;
d. a fourth lockable pulley system bracket mounted to an interior wall of the ability box;
e. a fourth flexible and extendable one piece stretch cord extending from the fourth lockable pulley system bracket sequentially to the second upper middle inside rollers, to the second lower middle inside rollers, the fourth remote roller, one of the plurality of aligned third lower inside roller, one of the plurality of aligned third inside upper rollers and alternating over additional aligned second upper and lower inside rollers, then extending a fourth stretch cord length from the agility box to a fourth harness, wherein the fourth harness is configured to connect on or around a part of the subject targeted for speed and power development.

11. The speed and power development system of claim 1, wherein the moveable sled comprises a hollow tubular frame.

12. The speed and power development system of claim 1, wherein the moveable sled has a plurality of handles.

13. The speed and power development system of claim 1, comprising a second agility box mounted over the moveable sled opposite the first agility box.

14. The speed and power development system of claim 1, comprising both the front and rear ends of the moveable sled curve up from one to three inches on each of the front and back.

15. The speed and power development system of claim 1, comprising a removable drive arm engaging the movable sled, the removable drive arm engaging the horizontally oriented raised weight base secured over the moveable sled, the removable drive arm comprising:
a. a base extension connected to the horizontally oriented raised weight base;
b. an angled one piece extension extending upwardly from the base extension;
c. a welded point connected to the angled one piece extension opposite the locking drive arm base;
d. a drop flat bar extending from the weld point and adjustably mounted to the welded point; and
e. a forked piece extending from the drop flat bar, the forked piece comprising padding configured to allow a subject to push the sled with a head of the subject between the padding.

* * * * *